US006224110B1

(12) United States Patent
Ambridge et al.

(10) Patent No.: US 6,224,110 B1
(45) Date of Patent: May 1, 2001

(54) PERFORATED SELF-LAMINATING MARKER

(75) Inventors: Jane G. Ambridge, Duluth; William H. All, Marietta; Brian D. Soule, Ball Ground, all of GA (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 09/484,692

(22) Filed: Jan. 18, 2000

Related U.S. Application Data

(60) Provisional application No. 60/116,294, filed on Jan. 19, 1999.

(51) Int. Cl.[7] ..... B42D 15/00

(52) U.S. Cl. ..... 283/81; 283/109; 283/101; 283/70

(58) Field of Search ..... 283/79, 80, 81, 283/101, 105, 107, 109, 70, 67; 40/594, 299, 630, 306, 307

(56) References Cited

U.S. PATENT DOCUMENTS

| | | | | |
|---|---|---|---|---|
| 2,671,678 | | 3/1954 | Walsh . | |
| 2,767,495 | | 10/1956 | Harris . | |
| 2,979,840 | | 4/1961 | Eastman . | |
| 3,153,868 | | 10/1964 | Jones . | |
| 3,197,899 | | 8/1965 | Twentier . | |
| 3,252,234 | | 5/1966 | Goodman . | |
| 4,082,873 | | 4/1978 | Williams . | |
| 4,159,586 | | 7/1979 | Blum . | |
| 4,204,706 | | 5/1980 | Blum et al. . | |
| 4,790,563 | | 12/1988 | Instance . | |
| 4,907,359 | | 3/1990 | Berman . | |
| 4,925,716 | | 5/1990 | Haas . | |
| 4,986,868 | | 1/1991 | Schmidt . | |
| 5,058,926 | | 10/1991 | Drower . | |
| 5,083,979 | | 1/1992 | Burt . | |
| 5,240,789 | | 8/1993 | Breen et al. . | |
| 5,411,784 | * | 5/1995 | Brewster | 40/594 |
| 5,518,787 | | 5/1996 | Konkol . | |
| 5,662,976 | * | 9/1997 | Popat et al. | 283/101 |
| 5,773,111 | * | 6/1998 | Brewster | 283/81 X |

* cited by examiner

*Primary Examiner*—Willmon Fridie, Jr.
(74) *Attorney, Agent, or Firm*—Robert A. McCann

(57) ABSTRACT

A label assembly includes first and second longitudinally aligned portions releasably adhered to a liner with one of the portions having a side dimension greater than a width dimension of the other portion. After marking the label portion with the desired indicia, the label can be removed and applied to the desired object. Then the overlaminate portion having the larger side dimension can be removed from the liner rotated 90° and placed over the label to complete the overlaminate protected label assembly.

3 Claims, 2 Drawing Sheets

PERFORATED SELF-LAMINATING MARKER

This application claims the benefit of U.S. Provisional Application No. 60/116,294, filed Jan. 19, 1999.

TECHNICAL FIELD

The present invention relates generally to adhesive labels, and more specifically to a unitary, adhesive overlaminate label assembly.

BACKGROUND OF THE INVENTION

Overlaminate label assemblies in the past have been very difficult to manufacture, inconvenient to use and troublesome to install. Additionally, their use or availability in sizes compatible with small handheld printers is virtually nonexistent.

The label assembly offered by Brady Corporation similar to expired U.S. Pat. No. 3,252,234 may be compatible with small handheld printers, but the manufacturing process is difficult and expensive, while application of the label and transparent cover sheet is complex.

Therefore, a simple, inexpensive and easily manipulated label assembly is desired and improvement in the art of overlaminate label assembly is needed.

SUMMARY OF THE INVENTION

It is, therefore, an object of the present invention to provide an improved label assembly.

It is another object of the present invention to provide an improved method of applying a label with a protective overlaminate layer.

In general, a label assembly in accordance with the present invention includes a liner base, a label stock releasably situated on the liner base, said label stock being separated into a first and a second portion by a perforation line and including an adhesive layer on the underside, and wherein the first portion includes an opaque layer allowing indicia to be marked thereon, and the second portion has a side dimension greater than a width dimension of the first portion.

DESCRIPTION OF PREFERRED EMBODIMENTS

Figure 1:
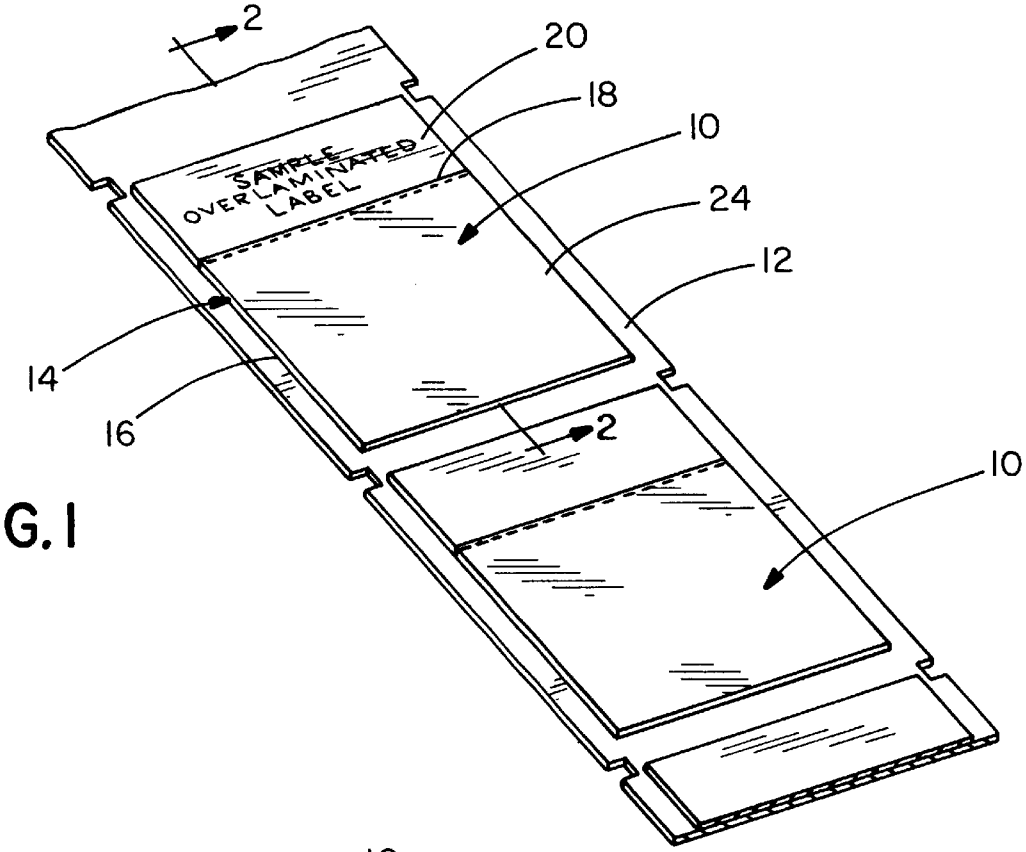
FIG. 1 is a perspective drawing of label assemblies embodying the concept of the present invention.
Figure 2:
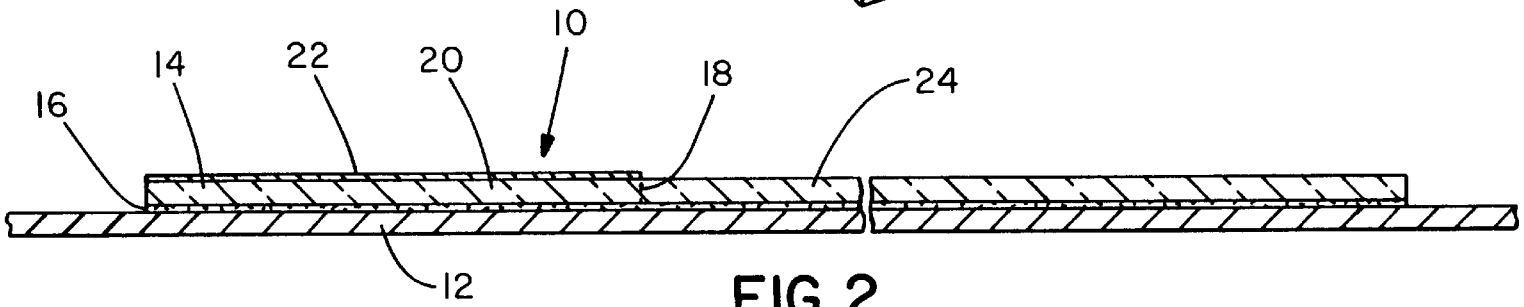
FIG. 2 is a sectional view of the label assembly of FIG. 1 taken along line 2—2 of FIG. 1.

A label assembly 10 embodying the concept of the present invention is generally shown in FIG. 1. In the commonly available configuration, a series of discrete label assemblies are releasably affixed to a liner in a longitudinally aligned manner. The elements which generally comprise each label assembly are shown in cross-section in FIG. 2. As previously mentioned, the liner 12 forms the base. Above this is the label stock 14 which is generally a substantially, clear plastic material. An adhesive layer 16 is permanently affixed to the underside of the label stock, and provides an adhesive function after the label 14 is removed from the liner. The label stock 14 is divided into two sections by a perforation line 18.

The first portion 20 also includes an additional opaque layer 22 which is transferred and permanently attached to the smaller portion by way of screen press or flexography. This first portion 20 thus constitutes the printable label portion of the over laminate label assembly. The second portion 24, without the additional opaque layer, constitutes the overlaminate protective layer of the label assembly. As best seen in FIG. 1, the area of the first portion is noticeably less than that of the second portion. As also can be seen, the width dimension for both the first label portion and the second overlaminate portion is the same. However, the side or height dimension of the second portion is greater than the width of both first and second portions.

Figure 4:
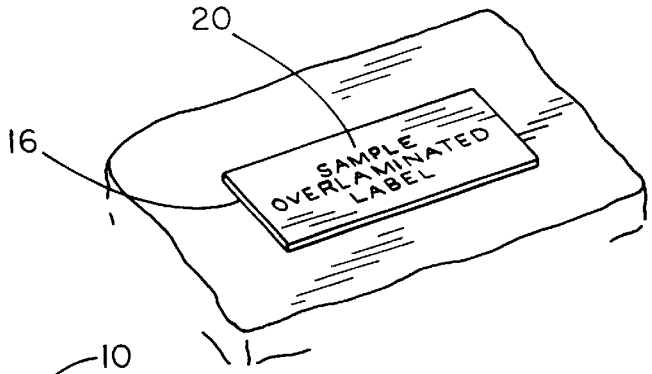
FIG. 4 is a perspective view of the second step of affixing the label assembly of FIG. 1.
Figure 3:
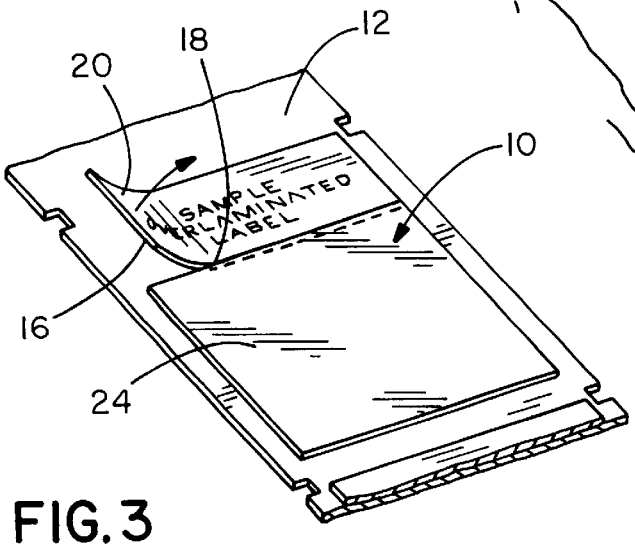
FIG. 3 is a perspective drawing of the first step of affixing the label assembly of FIG. 1.

FIGS. 3–7 generally show the method of operation to affix the label system. First, the desired indicia is transferred by a handheld printer or other method to the opaque first portion 20 of the label stock 14. Then, first portion 20 may be removed from releasable liner 12 independent from the clear, overlaminate second portion 24. The line of perforation 18 enables this step of operation to be accomplished relatively easily. Next, as shown in FIG. 4, the first portion 20 with printed indicia is affixed to the desired object via the underlying adhesive layer. Then, second portion 24 may be removed from liner 12, rotated 90° and centered over the first portion. The rotation of the second portion is in the plane of the height and width of the assembly. That is, the rotation turns a side to the top, the top to a side, etc. Thus, the rotating of second portion 24 90° allows for the height or side dimension of second portion 24 to be aligned with the width dimension of first portion 20. Since this side dimension is larger than the width dimension of the first portion 20, the second portion 24 completely encircles and covers the smaller first portion 20.

Figure 6:
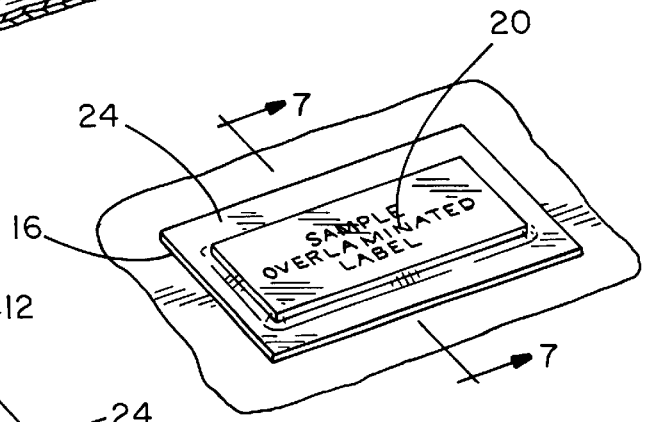
FIG. 6 is a perspective view of the fourth step of affixing the label assembly of FIG. 1.
Figure 5:
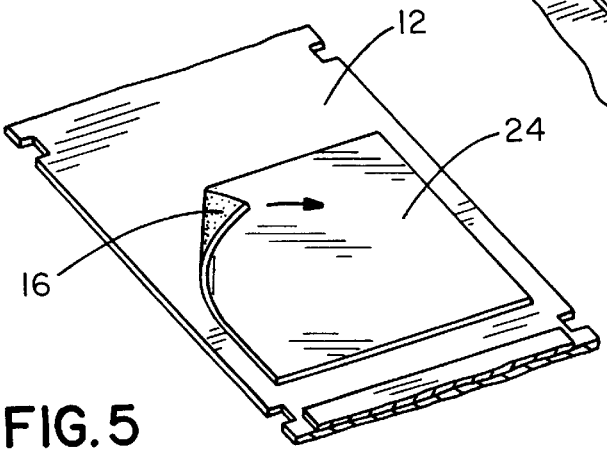
FIG. 5 is a perspective view of the third step of affixing the label assembly of FIG. 1.
Figure 7:
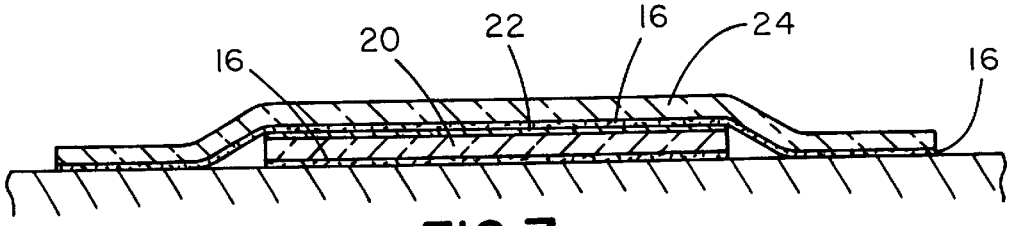
FIG. 7 is a sectional view of the affixed label assembly of FIG. 1 taken along line 7—7 of FIG. 6.

The final mounted assembly, as generally shown in FIGS. 6 and 7, shows the clear overlaminate second portion 24 completely encircling and covering the smaller, imprinted first portion 20. By this configuration, the printed indicia is protected from the elements or other harmful actions and will remain in a readable condition nearly indefinitely. The longitudinally aligned configuration of the label assemblies on the liner reduces costs, improves manufacturability, and increases productivity. The slim width profile allowed by this configuration accommodates the small handheld printers now being used.

While the particular embodiment of the present invention has been shown and described, it will be obvious to those skilled in the art that changes and modifications may be made without departing from the invention and its broader aspects. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A label assembly, comprising:

a liner base; and a generally rectangular label stock releasably situated on said liner base, said label stock being separated into first and second generally rectangular portions by a perforation line and including an adhesive layer on an underside thereof;

said first and second portions having equal width dimensions such that said portions are longitudinally aligned on said liner base;

wherein said first portion includes a layer allowing indicia to be marked thereon, and said second portion has a length dimension greater than said width dimension of said first portion.

2. A method of affixing a label to desired subject matter wherein said label includes a protective overlaminate portion completely encircling and covering a smaller imprinted label portion, said method comprising the steps of:

providing a generally rectangular label stock releasably adhered to a liner, wherein the label stock includes a generally rectangular first portion having a printable top surface and a generally rectangular second portion separated from said first portion by a perforation, wherein said first and second portions have equal width dimensions such that said portions are longitudinally aligned on said liner, and wherein said second portion has a length dimension larger than said width dimension of said first portion;

removing said first portion from said liner base and placing said first portion on said desired subject matter; and removing said second portion from said label stock, rotating said second portion 90°, and placing said second portion over said first portion.

3. A method as set forth in claim 2, further including the step of marking indicia on said first portion prior to removing said first portion from said liner.

* * * * *